United States Patent [19]

Beden

[11] 4,319,546

[45] Mar. 16, 1982

[54] HYDRAULIC COMBUSTION ENGINE

[76] Inventor: Moses M. Beden, 420 Revere Beach Blvd., Revere, Mass. 02151

[21] Appl. No.: 141,684

[22] Filed: Apr. 18, 1980

[51] Int. Cl.[3] ..... F02B 75/32

[52] U.S. Cl. ..... 123/19; 123/197 AC; 91/5

[58] Field of Search ..... 123/19, 46 R, 46 A, 123/46 SC, 197; 91/5

[56] References Cited

U.S. PATENT DOCUMENTS 2,477,376 7/1949 Jacobsen ..... 123/197 AC
3,208,439 9/1965 Ulbing ..... 123/46 SC
3,998,049 12/1976 McKinley et al. ..... 123/46 R

FOREIGN PATENT DOCUMENTS 556675 2/1957 Italy ..... 123/19
590450 4/1959 Italy ..... 123/19

*Primary Examiner*—Craig R. Feinberg
*Attorney, Agent, or Firm*—Wolf, Greenfield & Sacks

[57] ABSTRACT

A piston engine, that may comprise one or more piston assemblies, employs hydraulic pressure principles in combination with an internal combustion construction to minimize the fuel required to operate the engine. The engine includes multiple assemblies for housing a small upper piston operated in an oscillating manner from combustion at the top surface of the piston, a large piston below the small piston operated through a hydraulic medium from the upper piston, and output means from the large piston including a crankshaft or the like, preferably a short stroke crankshaft. By employing a small piston on top, maximum hydraulic force is transferred to the larger piston to increase operating efficiency.

17 Claims, 3 Drawing Figures

HYDRAULIC COMBUSTION ENGINE

BACKGROUND OF THE INVENTION

The present invention relates in general to a piston engine which may be of the internal combustion type. More particularly, the invention relates to a piston engine that employs a hydraulic fluid as a medium for the transfer of force between a piston subjected to combustion forces and a second output piston.

One prior art patent that employs a hydraulic fluid as a medium for force transfer is the Savarimuthu, U.S. Pat. No. 4,085,710. However, this prior patent does not take advantage of the increased forces possible with the proper use of the hydraulic pressure, by means of the proper selection of piston size. In this prior art patent the larger piston is used at the top adjacent to the combustion chamber, and the smaller piston is the output piston. However, this means a decrease in force applied through the transfer medium. Thus, the prior art patent provides a force reduction and not intensification.

Accordingly, one object of the present invention is to provide an improved piston engine employing a hydraulic transfer medium and in which the hydraulic fluid permits an increase in force applied to the output piston.

Another object of the present invention is to provide a piston engine that is characterized by an increased energy conservation of fuel. In accordance with the present invention, the fuel requirements are minimized for operation of the piston engine.

Still another object of the present invention is to provide an improved piston engine employing a hydraulic transfer medium which is characterized by the reduction substantially of pollutant exhaust, extreme simplification of the engine construction and elimination of the radiator cooling system with water pumps, hoses, etc.

Another object of the present invention is to provide an improved piston engine, of the type employing a hydraulic transfer medium, and which can employ a variety of fuels, combustible or noncombustible, with or without standard ignition means.

SUMMARY OF THE INVENTION

In accordance with the present invention, there is provided a hydraulic combustion engine employing two pistons intercoupled by a hydraulic fluid for power transfer. The engine of this invention provides maximum energy conservation of the fuel that is used. A minimum fuel requirement for energization of the engine is a major characteristic of the invention described herein. There is, thus, an increase in efficiency along with a substantial reduction in pollutants.

The engine of this invention comprises an engine block which in the preferred embodiment is provided in three sections including a cap assembly which forms at least in part a combustion chamber preferably at the top of the engine block. The other portions of the engine block include an intermediate assembly in which is disposed a first cylindrical piston arranged with one end facing the combustion chamber. There is also provided a second cylindrical piston. The block has means defining a cylindrical chamber for slidably receiving the first piston and a second cylindrical chamber for slidably receiving the second piston. Both of these pistons are preferably cylindrical shape, although other configurations of a piston may be provided. The hydraulic fluid may be of conventional type and is contained in the engine block for coupling and permitting power transfer between the pistons. The pistons are preferably coaxially disposed, although, in an alternate arrangement, the pistons are disposed for operation in parallel. In the coaxial arrangement, the first piston is disposed above the second piston and means are provided preferably in the form of a coil spring for helping to restore the top or first piston to its top dead center position. The lower or second piston preferably couples by means of a connecting rod or the like to an output shaft. Associated with the output shaft is preferably a booster gear arrangement which may couple to a flywheel and transmission means. In accordance with the invention, the first piston, or preferably the top piston, has a fluid-facing bottom end surface of lesser area than the fluid-facing top surface of the lower or second piston to thereby provide increased force to the second piston. In this way, advantage is taken of the hydraulic principles for substantially increasing the force imparted to the second piston through the power transfer medium in the form of a hydraulic fluid. There is also provided a hydraulic reservoir coupling to the engine block for the automatic replacement of any hydraulic fluid to the engine.

The combustion chamber has associated therewith valve means and an ignitor such as a spark plug. In accordance with a proper timing cycle, a minimum of fuel mixture is conveyed to the combustion chamber and is energized and instantly exploded creating an immediate expanding volume of gas which drives the top piston. The top contacting surface of this piston is preferably formed with a conical or cup-shaped recess thus forming a focusing surface for the applied force. This action propels the upper small piston away from the combustion chamber in a downward direction in the preferred embodiment. The propelled small piston creates energy which is force transferred through and by the hydraulic fluid to the lower piston which also preferably has an upper conical recess for receiving and focusing the force. This force impacting upon the large piston is converted to a measurably increased pressure force which is passed by the lower piston to the output short stroke crankshaft. As the lower piston progresses downwardly and upwardly, the piston position is reversed and the hydraulic fluid then moves upwardly, pushing forcefully the upper small piston to the upper stop ring, ready for the next firing cycle. This occurs in a continuous action. In accordance with the principles of the present invention, the ratio of diameter of the two pistons is at least 2 to 1 and up to a ratio of 5 to 1 or more. This provides at least a doubling of the force or more applied through the hydraulic medium. The larger piston moves at a slower speed but with increased power. This loss of speed may be compensated by the use of a flywheel in combination with booster gears.

BRIEF DESCRIPTION OF THE DRAWINGS

Numerous other objects, features and avantages of the invention should now become apparent upon a reading of the following detailed description taken in conjunction with the accompanying drawing, in which.

DETAILED DESCRIPTION

Figure 1:
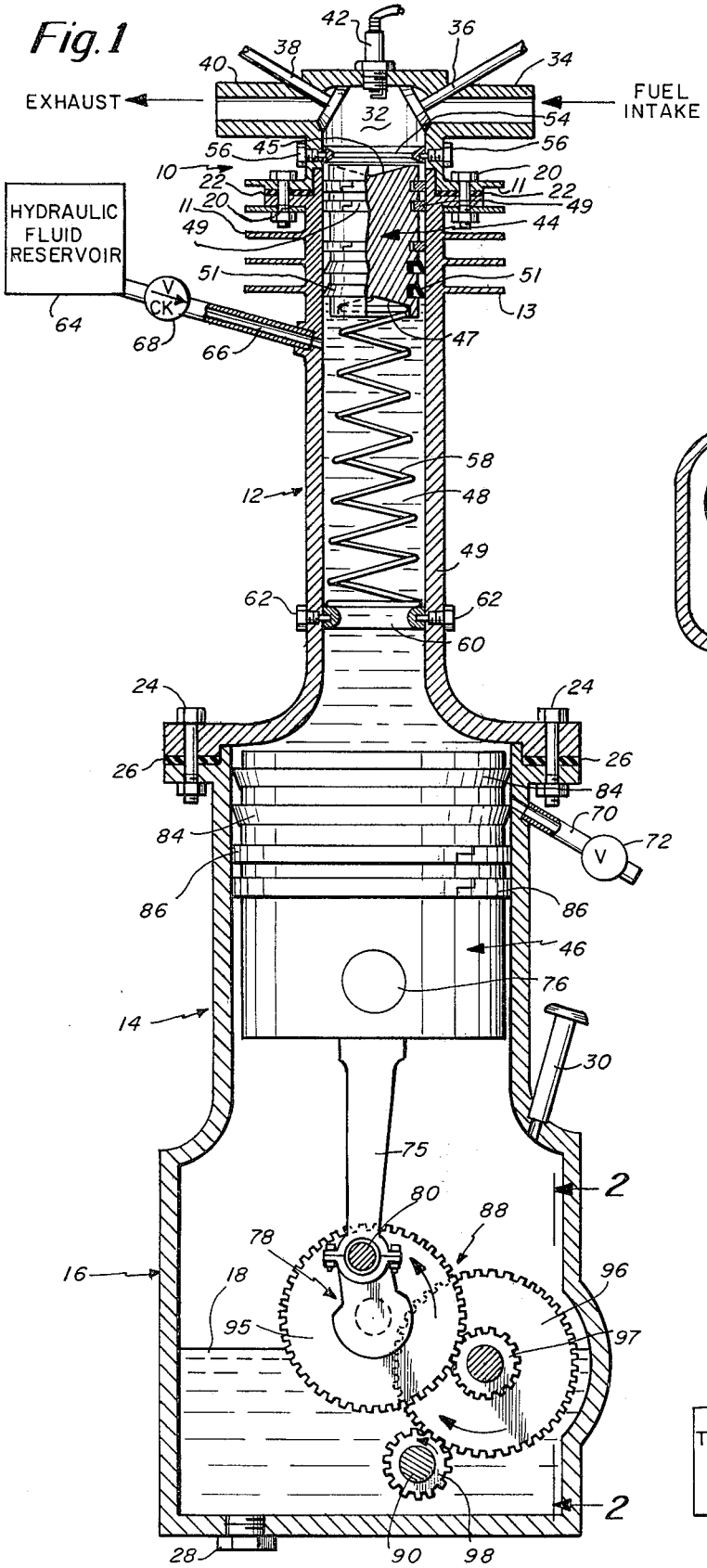
FIG. 1 is a cross-sectional view showing a preferred embodiment of the hydraulic combustion engine of this invention employing two pistons arranged in a coaxial manner.
Figure 3:
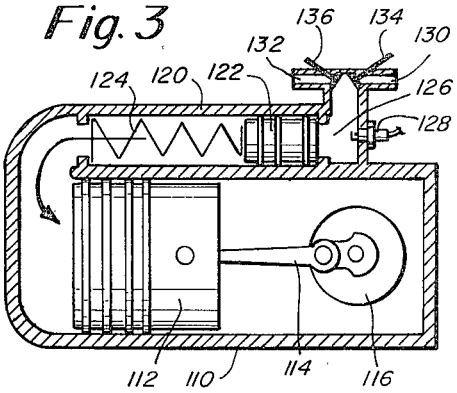
FIG. 3 is a schematic diagram of an alternate embodiment of the invention wherein the pistons are arranged for operation in parallel.
Figure 2:
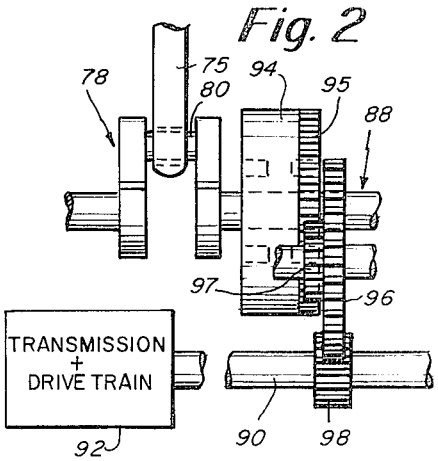
FIG. 2 is a side view in the area of the output gear arrangement as viewed along line 2—2 of FIG. 1.

Referring now to the drawings, FIGS. 1 and 2 depict the preferred embodiment of the present invention employing two pistons housed in a cylinder block with the pistons being arranged coaxially. The schematic diagram of FIG. 3 depicts an alternate piston arrangement wherein the two pistons are disposed for operation in parallel. Other alternate arrangements can also be devised wherein the two pistons are disposed in different positional relationships with regard to each other.

In FIG. 1, the two piston arrangement is shown contained within an engine block that comprises three separate sections. The lower piston connects to a very short stroke crankshaft which may also support other double piston arrangements. Thus, the engine block or casing comprises a cap assembly 10, an intermediate assembly 12, and a lower assembly 14 including a crank case 16 in which a lubricating oil 18 is disposed. Each of the assemblies comprising the block may be secured together in a similar manner by the use of bolts, through extended flange or tabs, and a gasket. Thus, the cap assembly 10 is secured to the intermediate assembly 12 by means of bolts 20 and sealing gasket 22. Similarly, the intermediate assembly 12 is secured to the lower assembly 14 by means of bolts 24 and the gasket 26. The lower assembly 16 includes a drain plug 28, through which the oil may be drained from the crank case. There is also provided a filler tube 30 for introducing oil as a lubricant to the crank case.

The cap assembly 10 may be constructed of a cast metal and defines a combustion chamber 32 to which a gas-air mixture is conveyed from the fuel intake port 34. There is shown diagramatically a valve 36 which is controlled on a timed basis for operation to open, and close, after admitting the minimum fuel mixture into the combustion chamber 32 by way of the inlet port 34. Also, in accordance with a proper timing pattern the burned products of combustion within the chamber 32 are exhausted by opening of the valve 38 so that the burned products of combustion may be conveyed to the output or exhaust port 40. There is also shown in FIG. 1 a spark plug 42 which receives an electrical signal for causing ignition of the fuel mixture within the combustion chamber 32. The spark plug 42 is ignited at the top dead center position of the top piston 44.

In addition to the top piston 44 which is of a relatively small diameter, there is also provided in the apparatus of this invention a lower, larger diameter piston 46 with both of these pistons being intercoupled on a force transfer basis by means of the hydraulic fluid 48. The fluid 48 is contained basically in the intermediate assembly 12 and, in particular, in the column 49 thereof. The bottom of the assembly 12 is flanged for connection with the larger diameter base assembly 14. It is the bottom or base assembly 14 that primarily houses the larger diameter piston 46.

The engine described in FIG. 1 is preferably air cooled. This is possible with the construction that is used because of the high efficiency of this engine and, also, because of the use of a hydraulic fluid 46 which tends to absorb heat that is generated. The minimum fuel required products little heat and tends toward a cool running engine. Thus, the cap assembly 10 includes a series of fins 11 for cooling the assembly. Similarly, the intermediate assembly 12 also includes fins 13. These fins are disposed about the outer surface for providing air cooling.

The piston 44 is constructed of a metal such as cast iron or aluminum and has a series of annular grooves. The piston is also provided with a top conical recess 45 and a bottom conical recess 47. These recesses tend to focus forces for the purpose of increasing the efficiency of operation. The grooves in the piston 44 carry two or more piston rings 49 at the top end of the piston and two or more hydraulic seals 51 at the bottom end of the piston, or any suitable mixed placement of rings and seals. Mounted directly above the piston 44, in the position shown in FIG. 1, there is provided a piston stop ring 54 which is fixed in position in the cap assembly essentially at the lower part of the combustion chamber. The ring 54 is fixed in position by means of pin end cap screws 56.

The piston 44 is biased to its top dead center position by means of a strong cone-shaped coil spring 58. The spring 58 is fixed at its bottom end by means of a spring support ring 60 which is fixed within the column 49 by means of pin end cap screws 62. In the position at top dead center, the spring 58 may be under slight compression. The top end of the spring 58 is seated within the conical recess 47 in the bottom of the piston 44. In FIG. 1, for the sake of clarity, the piston 44 is shown having a relatively large clearance between its outer surface and the bore of the assembly. However, it is understood that this clearance would be relatively small, perhaps on the order of a few thousandths of an inch, up to about 0.032 inch on the diameter to allow for possible expansion by friction and combustion heat.

FIG. 1 also shows a hydraulic fluid reservoir 64 which may be conventional. This may be similar to a reservoir employed with a hydraulic braking system on a vehicle. The fluid in the reservoir 64 couples by means of a conduit 66 and a one-way check valve 68 for infill into the hydraulic oil 48, to the required full height level, which is at the lower hydraulic seal of the upper piston 44. This permits only an automatic one-way flow from the reservoir into the column 49 when additional hydraulic fluid is desirable. The conduit 66 may also have associated therewith a line valve for manually opening and closing the conduit.

There is also provided at the top end of the lower assembly 14 a conduit 70 coupling from the chamber housing the piston 46. This conduit may have associated therewith a manually operated valve 72 which is normally maintained closed. This valve can be opened for the drainage of hydraulic fluid 48 from the engine block.

The piston 46 is of a substantially larger diameter than the piston 44, and is connected to the connecting rod 75 by means of a piston pin 76. The connecting rod 75 at its other end connects to the short stroke crankshaft 78. FIG. 1 shows a crankshaft pin 80 where the connection occurs. The piston 46 has a plurality of annular grooves. Two, or possibly more, of the top grooves, as depicted in FIG. 1, carry hydraulic sealing rings 84. There are also provided two or more lower piston oil rings 86.

The crankshaft, as depicted in FIGS. 1 and 2, couples to a gear means 88. The output of the gear means couples to an output shaft 90 which in turn may couple to the box 92 which represents the use of a transmission and other drive train components. The gear means 88 comprises a plurality of gears and a flywheel 94. These gears include a large diameter gear 95, a second large diameter gear 96, and two smaller diameter gears 97 and 98. It is the gear 98 that is coupled directly to the output shaft 90. Extra booster gears may be added as desired to vary the output. This gear arrangement substantially steps up the rotation of the output shaft 90 to provide substantial enhancement of force coupled through the hydraulic fluid from the smaller end face of the small piston to the substantially larger face end of the large piston. For example, in one embodiment the piston 44 has an area facing the hydraulic fluid of one square inch, then the total force of one thousand pounds is subject to the hydraulic liquid. Assuming further that the larger piston has an area of ten square inches facing the hydraulic fluid, there will then be 10,000 pounds of output pressure directed to the crankshaft. Because the larger piston 46 has a substantial mass (diameter), the speed of rotation of the crankshaft is less than in the prior art arrangement. However, this is more than compensated for by the use of a booster gear arrangement depicted by the means 88 in FIGS. 1 and 2.

FIG. 3 shows one alternate arrangement in a schematic fashion. In this embodiment there is provided an engine casing 110 for housing a large piston 112. This piston connects by means of a connecting rod 114 to the short stroke crankshaft 116. Mounted above the casing 110 is a housing 120 defining a chamber for receiving the piston 122. FIG. 3 also shows the biasing spring 124 for helping to restore the piston 122 to its initial, dead center position. Above the piston 122 is the combustion chamber 126, and associated spark plug 128, intake port 130, and exhaust port 132. The ports 130 and 132 have associated therewith operating valves 134 and 136, respectively. The operation of the embodiment of FIG. 3 is substantially identical to that of FIGS. 1 and 2. Other embodiments and variations thereof, concerned with the fuel energy employed, operate similarly in an efficient manner.

In accordance with the operation of the engine of this invention, there is a timing sequence which controls the valves 36 and 38 so that a fuel mixture is admitted to the combustion chamber 32 and after ignition, is timely exhausted from the chamber. This fuel mixture is energized and upon explosion creates an immediate expanding volume of gas which drives the top piston 44. As indicated previously, the end surfaces of the piston 44 are conically recessed to provide a focusing of forces. Upon impacting the piston 44, this piston is forcefully propelled away from the combustion chamber in a downward direction. This action imparts a force to the hydraulic fluid medium which is transferred through this medium to the large lower piston. As a ratio of the impacting surfaces of the two pistons, there is a substantial increase in force at the lower piston by making the lower piston substantially larger in diameter than the upper piston. As the lower piston rotates on the short stroke crankshaft, it returns upwardly, thus, also causing a reversal of the hydraulic fluid. Thus, the hydraulic fluid pushes the small piston 44 upward with the help of the spring to the top stop ring 54 to its next starting cycle. The piston is thus essentially oscillating in the block and with the proper selection of piston sizes as in accordance with this invention, there is provided a substantial increase in force to the output crankshaft. The larger piston moves at a slower speed but with increased power. This loss of speed is compensated for by the use of a flywheel in combination with booster gears.

With the engine of this invention, there is permitted the use of a variety of different combustible liquids as the energy source. For example, gasoline, gasohol, or alcohol may be employed. Also, a gaseous energy fuel may be employed such as hydrogen, oxygen, propane, methane, or natural gas. The principles of the invention may also be applied to steam pressure engines and compressed air engines. With other modifications, the principles can also be applied to a diesel engine. Because of the significance of force increase realized through the hydraulic medium, there can be a substantial conservation of fuel. The engine construction also allows a substantial simplification of the engine design. The engine weight is substantially reduced. The air cooling feature of this invention eliminates such components as a radiator with its attendant water pump. The exhaust system is greatly reduced in size, and pollutants also reduced or eliminated completely. The ratio between the small piston and the large piston as far as their diameters are concerned may be in anywhere from ratio of one to two up to one to five or more. The booster gears are an important feature of the present invention. By their interaction, there is provided an increased output of power and speed. The booster gears may be embodied in the case 16, as shown, or may be provided separately encased outside of the crankcase but, of course, coupled to the crankshaft. The hydraulic fluid that is employed should be of the proper viscosity with antifreeze and lubricating properties. This also functions as a lubricant agent on all moving parts that it comes in contact with.

Also, the principles of the present invention may easily be employed in modifying existing engines for increased efficiency of operation.

What is claimed is:

1. A hydraulic combustion engine comprising:

an engine block, means defining a combustion chamber within the engine block, a first piston disposed with one side facing the combustion chamber and having hydraulic seal means, said block having means defining a cylinder chamber for slidably receiving the first piston, said one side of said first piston having a conical recess for focusing applied explosive force for the purpose of increasing the efficiency of operation, an open stop ring extending across said cyinder chamber above said first piston for limiting the upward motion of the first piston, said first piston also having a bottom surface recess, a second piston, said block having means defining a cylinder chamber fod slidably receiving the second piston, both said pistons being cylindrical with the first piston having a smaller diameter than the second piston, an open support ring disposed within said block and means locking the open support ring in a position intermediate the first and second pistons, a hydraulic fluid contained in the engine block coupling between the pistons for force transfer from the first piston to the second piston, means associated with the first piston for restoring the first piston to top dead center position comprising a biasing spring contacting at one end the bottom surface recess of the first piston and contacting at the other end said open support ring, valve means and ignition means associated with the combustion chamber, a hydraulic reservoir coupling to the engine block for coupling hydraulic fluid to the block between the piston, said hydraulic reservoir having a fluid coupling line and said hydraulic reservoir disposed in relation to said first piston to provide fluid fill at a full height level at least as high as the hydraulic seal means associated with said first piston, and output drive means coupled from said second piston comprising output shaft means and booster gear means for increasing rotation speed and power of the output shaft means to provide substantial enhancement of force coupled through said hydraulic fluid, said first piston having a fluid facing surface defined as said bottom recessed surface of lesser area than a fluid facing surface of the second piston to thereby provide increased force to the second piston.

2. A hydraulic combustion engine as set forth in claim 1 wherein said pistons are disposed for operation in parallel.

3. A hydraulic combustion engine as set forth in claim 1 wherein said engine block includes a cap assembly forming at least in part the combustion chamber, an intermediate assembly holding the first piston and a lower assembly holding the second piston.

4. A hydraulic combustion engine as set forth in claim 1 wherein both the top and bottom surfaces of said first piston are conically recessed.

5. A hydraulic combustion engine as set forth in claim 1 wherein there is included a crank shaft having a short stroke for increased dynamic efficiency.

6. A hydraulic combustion engine as set forth in claim 1 wherein said engine is air cooled.

7. A hydraulic combustion engine as set forth in claim 1 wherein each piston has two types of rings including a hydraulic sealing ring.

8. A hydraulic combustion engine as set forth in claim 1 wherein said smaller first piston is solid metal providing minimum wear and distortion.

9. A hydraulic combustion engine as set forth in claim 1 wherein said smaller first piston is solid and functions as a balance projectile without undo waivering and oscillations in its momentum and movement.

10. A hydraulic combustion engine as set forth in claim 1 wherein the bottom face of said smaller first piston has a double recess including a flat counterbore to seat the spring for balanced position return, and a conical recess to focus the developing hydraulic pressure.

11. A hydraulic combustion engine as set forth in claim 1 wherein said pistons are coaxially disposed with the first piston above the second piston.

12. A hydraulic combustion engine as set forth in claim 11 including hydraulic sealing means associated with each piston and piston rings associated with each piston.

13. A hydraulic combustion engine as set forth in claim 1 wherein said piston is made of a metal material of suitable strength.

14. A hydraulic combustion engine as set forth in claim 13 wherein said piston is made of cast iron.

15. A hydraulic combustion engine as set forth in claim 13 wherein said piston is made of aluminum.

16. A hydraulic combustion engine as set forth in claim 1 wherein said open support ring is disposed in the cylinder chamber for accommodating said first piston.

17. A hydraulic combustion engine as set forth in claim 16 wherein said spring is a helical coil spring having a base extending about the periphery of the open support ring.

* * * * *